US009181073B2

(12) United States Patent
Vervoort et al.

(10) Patent No.: US 9,181,073 B2
(45) Date of Patent: Nov. 10, 2015

(54) CLICK-AND-FIX COUPLING

(76) Inventors: Bart Vervoort, Poederlee (BE); Peter Geboes, Aartselaar (BE); Marc Hermans, Leopoldsburg (BE)

( * ) Notice: Subject to any disclaimer, the term of this patent is extended or adjusted under 35 U.S.C. 154(b) by 440 days.

(21) Appl. No.: 13/701,858

(22) PCT Filed: May 30, 2011

(86) PCT No.: PCT/EP2011/058859

§ 371 (c)(1),
(2), (4) Date: Mar. 15, 2013

(87) PCT Pub. No.: WO2011/151296

PCT Pub. Date: Dec. 8, 2011

(65) Prior Publication Data

US 2013/0167977 A1 Jul. 4, 2013

(30) Foreign Application Priority Data

Jun. 4, 2010 (EP) ..... 10164927

(51) Int. Cl.

| | |
|---|---|
| ***B67C 3/00*** | (2006.01) |
| ***B05B 9/08*** | (2006.01) |
| ***B65D 83/22*** | (2006.01) |
| ***B65D 83/38*** | (2006.01) |
| *B65D 83/20* | (2006.01) |

(52) U.S. Cl.

CPC ..... *B67C 3/00* (2013.01); *B05B 9/0833* (2013.01); *B05B 9/0894* (2013.01); *B65D 83/226* (2013.01); *B65D 83/38* (2013.01); *B65D 83/202* (2013.01)

(58) Field of Classification Search

CPC .. B05B 9/0833; B05B 9/0894; B65D 83/226; B65D 83/38

USPC ..... 222/541.1, 541.6, 153.06, 222/153.11–153.14, 394, 402.14; 141/346

See application file for complete search history.

(56) References Cited

U.S. PATENT DOCUMENTS

| | | | | |
|---|---|---|---|---|
| 3,549,053 | A * | 12/1970 | Anderson | 222/153.06 |
| 5,549,228 | A | 8/1996 | Brown | |
| 6,631,820 | B2 * | 10/2003 | Harrold et al. | 215/237 |
| 2003/0218026 | A1 * | 11/2003 | Moretti | 222/153.06 |
| 2008/0124432 | A1 * | 5/2008 | Ma | 426/115 |
| 2010/0089950 | A1 | 4/2010 | Helf et al. | |

FOREIGN PATENT DOCUMENTS

| | | |
|---|---|---|
| WO | WO9843894 | 10/1998 |

* cited by examiner

*Primary Examiner* — Donnell Long

(74) *Attorney, Agent, or Firm* — Jerold I. Schneider; Schneider Rothman Intellectual Property Law Group, PLLC

(57) ABSTRACT

An improved coupling piece for the Click-and-Fix coupling of a disposable pressure container with a dispensing gun is provided, including an integrated cap and internal support legs for securing the position of the stem of the valve of the container when pressure increases inside the container, and which coupling piece may be produced as one single product using injection moulding. Further provided is an assembly of a container with the coupling piece, and a process for producing the coupling piece and the assembly. The coupling piece and/or the assembly may be further adapted for handheld use with a suitable handheld applicator.

22 Claims, 8 Drawing Sheets

CLICK-AND-FIX COUPLING

CROSS-REFERENCE TO RELATED APPLICATIONS

This application is the entry into the United States of PCT Application Number PCT/EP2011/058859 filed May 30, 2011 and claims priority from European Patent Application Number EP/10164927.5 Filed Jun. 4, 2010, the entirety of each of which are hereby incorporated by reference.

FIELD OF THE INVENTION

The current invention relates to containers, cans or canisters containing a compound under pressure, in particular disposable containers, and which can be coupled to a dispensing device, for example a dispensing gun, for applying the compound. The compound may comprise one or more active components, and may be suitable to form for example a sealant (e.g. a silicone paste), a polyurethane (PU) foam, or a one or a two component glue. The invention is particularly concerned with improvements in the pieces forming the coupling between the container and the dispensing device, and/or the container with a suitable handheld applicator.

BACKGROUND OF THE INVENTION

Containers under pressure, containing compounds such as pastes, foams or glues, find increasing use in the building industry as well as in do-it-yourself (DIY) activities. These containers are usually disposable containers. Generally two types of applicators are used in current practice. Occasional and DIY users typically prefer a simple handheld applicator, usually also disposable, which is typically screwed onto the stem of the valve of the container and usually comprises a hose or tube for guiding the flow of the compound to its intended location, and a tilting adaptor or lever. Such handheld applicators are characterised in that they do not themselves contain a valve for stopping or controlling the flow of compound, but act on the valve provided on the container for those purposes. Consequently, any compound having passed the container valve and entered the handheld applicator is exposed to the atmosphere and, if susceptible, may react further and convert into its ultimate and usually rigid consistency. For these reasons, these adaptors are simple in design and production, cheap, but most often only useable once, and thus disposable. Typically an action on the tilting adaptor or lever provided as part of the handheld applicator results in a tilting or pushing down of the stem of the container valve, such as in its surrounding rubber grommet in case of a conventional valve, relative to the cup of the valve, such that one or more openings in the valve stem are set free into the container contents, thereby opening the container valve. The assembly is such that the user may hold the container while pushing the tilting adaptor, which provides a rough means for controlling and dosing the compound flow. U.S. Pat. No. 4,165,825 discloses suitable valves for such handheld applications. The compound dosing with such handheld systems is however rather inaccurate, and such a system is therefore more suitable for filling large crevices or cavities, such as those wider than 2 cm.

The more intensive users, such as professionals or more experienced DIY users, typically prefer a more sophisticated dispensing device, such as a foam-dispensing gun, for applying the compound. With such dispensing devices, the user holds and manipulates the foam-dispensing device or dispensing gun, with the compound container being attached to the gun. Such dispensing guns are characterised in that they comprise their own valve, preferably a needle-valve for higher accuracy and better closure, for stopping or controlling the flow of compound, and this valve is usually located at the tip of the gun barrel and much more sophisticated than the container valve. It typically allows for a much better control of the compound flow as compared to the container valve. Because this valve is located at the tip of the barrel, there remains after use little to no volume of compound which has been exposed to the atmosphere and may react and become rigid. The compound inside the dispensing gun remains under pressure and sealed from the atmosphere, except for the short time required for exchanging a container on the dispensing gun. This time is usually short, and the dispensing gun is typically used immediately after the exchange, such that the compound inside the dispensing gun is refreshed and after use this new compound remains under pressure and fresh in its fluid state. These dispensing guns are usually more complex and expensive and are typically reused several times after replacing the previous empty container with a fresh and full one. The use of these dispensing guns is more comfortable for the user, and allows a higher accuracy and dosing in the application of the compound than the handheld system. Dispensing guns are therefore also preferred for filling up smaller crevices, such as those smaller than 2 cm wide. The higher dosing accuracy allows working with less excess compound, which usually needs to be removed later and ends up as waste. This reduces the amount of aftercare work required and brings a higher efficiency in material use. Both these advantages are of high interest to the professional or intensive user.

Containers intended for the intensive user are for this purpose conveniently provided with a first coupling piece, usually made from a plastic material, which makes the container suitable for attachment to the dispensing gun or dispensing device, and which matches with a connection element integrated in the dispensing device or dispensing gun, or with a second coupling piece which is attached to the dispensing device or dispensing gun, also called a gun adaptor, usually made of metal, such as aluminium or bronze, for making the coupling with the dispensing device or the dispensing gun. A suitable foam dispensing gun is for instance disclosed in U.S. Pat. No. 5,271,537, whereby the device comprises a screw connection into which a container may be screwed which has a suitable screw connection, usually by means of a suitable coupling piece on the container.

This screw connection or first coupling piece typically surrounds the valve which closes off the container. The screw coupling is usually provided such that when the screw connection is being effected, usually by manually tightening the screw until the stop position is reached, at the same time the valve of the container is brought into the open position and flow of the compound in the container is made possible from the container into the dispensing gun, where it may be stopped and/or controlled by the valve in the dispensing gun. For this purpose, a central internal extension is usually provided on the dispensing gun, or as part of the second coupling piece or gun adaptor, which upon effecting the coupling engages with the stem of the container valve and pushes the valve down in the open position, usually at the same time also providing a seal around the stem of the container valve such that the compound is only allowed to flow via the intended channel through the dispensing gun and avoiding any escape of compound into undesirable locations, where it would foul up the coupling pieces or the dispensing gun. Such a screw coupling typically requires a plurality of full windings in multiple manual handling steps in order to effect the coupling, and this is time consuming for the intensive user and may lead to unintentional spillage of the compound.

WO 98/43894 discloses an also rotatably connecting, alternative bayonet-type coupling system for such assembly of a container and a dispensing gun. This system is commonly called a "Click-and-Fix" system, and provides the advantage compared to the screw coupling that the coupling is effectuated in maximum one turn, preferably in less than a full turn, and preferably as little as only half or even about a quarter turn, and thereby in a much shorter time. Preferably the coupling may be closed in one single swift movement. With this system, the two coupling pieces are preferably made from plastic such as nylon 6 or polypropylene, and optionally a fibre reinforced plastic. This coupling system is much simpler and faster to operate, and requires less user handling compared to the several windings needed to effect the screw coupling discussed before. Because the coupling is closed quickly, there is also much less risk for accidental or unintentional leakage of container content, which may end up on the dispensing gun or on the second coupling piece, and therefore reduces the risk that the dispensing gun or the coupling piece needs to be cleaned before a new container may be coupled onto it. These advantages are of high convenience, in particular to the intensive user.

It should be noted that in all these designs, the first coupling piece needs to be strongly attached to the container, because the connection needs to withstand the force required for opening the valve, as well as the force exerted by the pressurized content of the container on the dispensing gun when the valve is opened. It also needs to withstand the torque force when the connection is being effected.

As it is commercially offered with its content under pressure, the container or canister intended for use with the dispensing gun is thus typically different from the container intended for handheld use, i.e. for use with a handheld applicator. The container for professional use is thus usually provided with a first coupling piece which is so strongly attached to the container that its removal, which would be required to allow attaching the handheld applicator for handheld use, would require a prohibitively strong force for the typical occasional or DIY user. It would also lead to unsafe situations, e.g. creating a risk for unintentionally ripping off the valve. Consequently the supply chain has been carrying two types of containers having different designs, one designed for use with the dispensing gun, and the other for use with the handheld applicator.

The containers itself are typically made of metal and cylindrical in shape. The bottom is usually formed by a plate flanged to the cylinder and typically is concave for better withstanding the internal pressure while maintaining the ability for the container to stand upright on a flat surface. The top is usually provided with a container head, also flanged to the cylinder, and which is typically convex for the same reason of higher pressure resistance. A filling opening is usually provided centrally in the cylinder head. When preparing the container for market, the empty container is typically filled with the compound through this central filling opening in the head, which subsequently may be closed off by flanging the container valve into the filling opening. Many compounds may be filled into the container under atmospheric pressure, and a higher pressure may subsequently be built up or introduced into the container, usually after it is closed off as described. An example wherein pressure builds up after closing the container are the compounds for polyurethane foam, in particular the one-component-foam (OCF), in which, after filling the container, an exothermic chemical reaction between the compounds may be initiated, such as by shaking the container, and the reaction produces heat and builds up pressure by the production and/or vaporisation of propellants. Propellants for building up the pressure may also be introduced at the moment of filling the container, such as a cold liquid which then is allowed to vaporise after closing the container.

We have found that the valve cup, i.e. the metal part of the container valve which is flanged to the container head and which may support the valve stem, or the rubber grommet through which sticks the typically plastic stem of the conventional valve, may be pushed outward when the pressure builds inside the container, especially when the exothermic reaction temporarily also raises the temperature. This may have as an effect that the valve stem moves away from its initial position. We have also found that the distance that the valve stem may be moved may vary from container to container, and that this distance is difficult to predict as it depends a.o. on the internal pressure in the canister. This brings as a result that the valve stem position may be different from the expected position and not anymore optimal for when the coupling has been effectuated. This repositioning of the valve over an unpredictable distance may thus affect the opening of the valve when the coupling between the container and the dispensing gun is made, such that, upon closing the coupling, the valve may not always reach a desirable degree of opening, or may not open at all, or reversely the valve may open too soon and cause accidental spillage of compound. Both the screw coupling and the Click-and-Fix coupling may face this problem, and we have found that a Click-and-Fix coupling may be somewhat more vulnerable, in particular the smaller the rotational movement is that is chosen for fully connecting the two coupling pieces.

This problem of valve repositioning may be avoided by bringing the first coupling piece of the Click-and-Fix coupling system into place on the container before the pressure is built up inside the container, and by providing the first coupling piece with an internal rim (also called a "support-ring") which, upon attachment of the first coupling piece to the container, engages with the valve cup such that the valve stem is retained in place in spite of any increased pressure inside the container. WO 98/43894 discloses a Click-and-Fix coupling system of which the first coupling piece is provided with such internal rim for retaining the valve cup, and thereby also the valve stem, into its initial position.

The containers of the present invention may comprise, under pressure, compounds which are still highly reactive and react out after the compound has been applied into its final location, such as in a crevice or on to a substrate. Contact of the container content with skin, or even more importantly with eyes, is therefore to be avoided. For safety reasons, the containers ready for market are therefore always provided with a protecting cap, which is supposed to shield the container valve and in particular the valve stem from being damaged, ripped off or being touched and moved relative to the valve cup, and thus for reasons of safety and for protecting against accidental spillage. The containers for handheld use are typically supplied without a coupling piece, i.e. with the valve fully accessible. Therefore such containers are conventionally supplied with a separate shielding cap which is usually clicked onto the flange around the container head. The containers for professional use are provided with the first coupling piece snapped onto the flange around the valve cup, and with the Click & Fix system additionally also snapped onto the flange around the container head, as explained in WO 98/43894, which provides extra strength. Access to the valve stem through these first coupling pieces is then typically closed off with a separate shielding cap, which may for instance snap on to the upper rim of the coupling piece, which may be suitably adapted for snapping on the cap, such as by providing a small collar.

Separate caps have been designed, and the heads of the coupling pieces on the containers may be made suitable to accept these caps as seals for the valve compartment. This design requires the separate production of a cap and the need for an extra step in the assembly of the container, i.e. to put the cap onto the head of the coupling piece.

This shielding cap thus represents an extra element which needs to be produced separately and needs to be assembled with the coupling piece before or after snapping the coupling piece on the container. The shielding cap for the container intended for handheld use also represents a separate assembly element. These shielding caps therefore create an extra burden in the supply chain of the containers, in the sense that there is a need to carry two types of containers and for both types an extra assembly element has to be provided and assembled.

There has therefore been a need for a two-in-one design, i.e. a container which would be suitable for use with a dispensing gun as well as with a handheld applicator, and/or a handheld applicator which would be suitable for use with the container assembly intended for use with the dispensing gun.

WO 2007/112758 discloses a handheld applicator which may be fastened onto the valve stem of a container intended for use with the dispenser device. The handheld applicator may then be "clicked" directly on the valve stem. The difficulty with this design is that fastening of the handheld applicator onto or off the valve stem needs to be performed very carefully, as any tilting of the valve would cause premature and unintentional spillage of compound, and any damage to the valve may create a safety hazard.

US 2007/0181610 A1 discloses a handheld applicator which is suitable for being snapped onto the flange around the container valve. The drawback with this proposal is that the first coupling piece, with which a container for use with a dispensing gun is usually sold, needs to be removed from the container before the flange is available for snapping on the handheld applicator. The difficulties and safety issues of such a removal have been discussed above.

Other systems have been developed, where a handheld applicator may be screwed into a threaded internal section of the coupling piece intended for the dispenser device. The difficulty with such systems is that the valve opens while the applicator is being screwed into place, and the degree of screwing defines the opening of the valve and thus the flow of the compound. Especially occasional users prefer to use their two hands for screwing on the applicator, and it is very difficult to achieve, at the same time while screwing on the applicator, also a good and accurate application of the compound.

Improved coupling pieces have also been designed for attachment to the container, whereby an integrated cap is provided for manually being broken off from the coupling piece, and upon removal providing access to the valve of the container. In some versions these integrated caps are made such that the cap, after having been broken off, may be replaced again onto the coupling piece, such that the valve compartment may be reclosed, such that a partially used container may be transported and stored safely and conveniently before being used again. Improved coupling pieces having these features have been designed such that they may be produced as one single product in a single production step, such as by a single injection moulding step. This design of a coupling piece with integrated cap for single step production is however incompatible with the provision of the internal rim, also called the "support ring", which is desired for offering additional and exterior support to the valve cup, such that the valve stem is retained in place when the pressure inside the container builds up, such as part of the Click-and-Fix system disclosed in WO 98/43894.

There therefore remains the need for an improved coupling piece, for attachment to a container, which is provided with an integrated cap and also with internal legs providing exterior support for the container valve cup, and which may be produced as a single product in a single production step. There remains a further need for a two-in-one design, i.e. a coupling piece which at the same time provides the possibility without having to first remove the coupling piece for coupling the container with a suitable handheld applicator, i.e. for handheld use, which only may open the valve after the handheld applicator has been coupled to the coupling piece and the container.

The present invention aims to obviate or at least mitigate the above described problem and/or to provide improvements generally.

SUMMARY OF THE INVENTION

According to the invention, there is provided an improved coupling piece, an assembly of the coupling piece and a container containing a compound, a device comprising the assembly and a dispensing gun for applying the compound, as well as a process for the production of the coupling piece, of the assembly and of the device, as defined in any of the accompanying claims.

The invention therefore provides a first coupling piece for attachment to a container which coupling piece is rotatably connectable to a second coupling piece provided for attachment to a dispensing gun for applying a component present in the container, the two coupling pieces together providing a coupling between the container and the dispensing gun, the container comprising a container valve for closing off the container, whereby the container valve comprises a valve cup and is provided for being opened during effectuation of the coupling, one of the two coupling pieces being provided with a guide and the other coupling piece being provided with a protrusion for cooperating with the guide, which protrusion is moveable within the guide between a first position and a second position, in not more than one full 360 degree turn, the first position corresponding to an uncoupled state of the coupling and a closed position of the container valve, and the second position corresponding to a coupled state of the coupling and an opened position of the container valve, characterised in that (i) the first coupling piece comprises an integrated cap provided for being broken off manually and for requiring its removal in order to allow an effectuation of the coupling, (ii) the first coupling piece comprising one or more internal support legs which are providing an internal rim or sections of an internal rim for engaging with the container valve cup when the first coupling piece is attached to the container, (iii) whereby the integrated cap is provided with open segments, and (iv) whereby the area covered by a first projection, of the open segments in the cap and made along the axis of rotation of the coupling and onto a plane perpendicular to this axis of rotation, comprises the area covered by a second projection, made along the same axis and onto the same plane, of the internal surfaces of the internal support legs which face the axis of rotation.

The coupling piece according to the invention provides the combined advantages that (a) it is provided with an integrated cap for shielding the valve of the container it is intended to be attached to, (b) it provides exterior support for the container valve cup such that the container valve stem is retained in position when the pressure inside the container increases subsequent to attachment of the coupling piece to the container, and (c) the coupling piece may be produced as a single product in a single production step, such as by injection moulding. In addition, the coupling piece according to the invention still matches the "Click-and-Fix" second coupling piece for attachment to the dispensing gun.

The invention further provides for an assembly of a container with the first coupling piece according to the invention. This assembly brings the advantage that the position of the container valve stem relative to the coupling piece is retained even when pressure has increased inside the container. This results in a more correct valve opening after effectuating or closing the coupling between the two coupling pieces, thus avoiding the risk of insufficient, or conversely of premature valve opening.

In another embodiment, the invention provides for a process for producing the coupling piece according to the present invention, comprising a step of injection moulding. The first coupling piece according to the invention may be produced as one single product in one single production step, with a mould suitably designed for that purpose, and which may comprise a plurality of mould elements which are able cooperate in order to form the first coupling piece with the integrated cap and the internal support legs for supporting the container valve cup of the container it will be attached to.

In a preferred embodiment the coupling piece of the present invention further comprises first means suitable for coupling with a suitable handheld applicator for applying the component present in the container, which handheld applicator is provided with second complementary cooperating means for providing the coupling between the first coupling piece and the handheld applicator, and being suitable, in an assembly of the container and the first coupling piece together with the handheld applicator, for enabling the opening of the container valve by an action on the handheld applicator.

This embodiment brings the advantage that the coupling piece is dual purpose, i.e. it may be used in combination with the second coupling piece for an application involving an application device or a dispensing gun, such as for intensive use by e.g. a professional or intensive DIY user or for smaller crevices, cavities or cracks, but it is at the same time also suitable for use in handheld mode, with a suitable handheld applicator, such as for less intensive use or for larger crevices, cavities or cracks. This brings the significant advantage that the supply chain only needs to carry one type of products, i.e. the assembly of a full container with the coupling piece according to this embodiment, in order to satisfy the needs of the two uses or type of users.

For the details of a handheld applicator which is suitable for coupling with the first coupling piece of the present invention, or with the assembly thereof with a container, the applicants refer to the copending patent application EP-A-10164924.2.

The invention thereby further provides for the use of the coupling piece or the assembly of the present invention with a handheld applicator suitable for handheld use.

DETAILED DESCRIPTION

Figure 1:
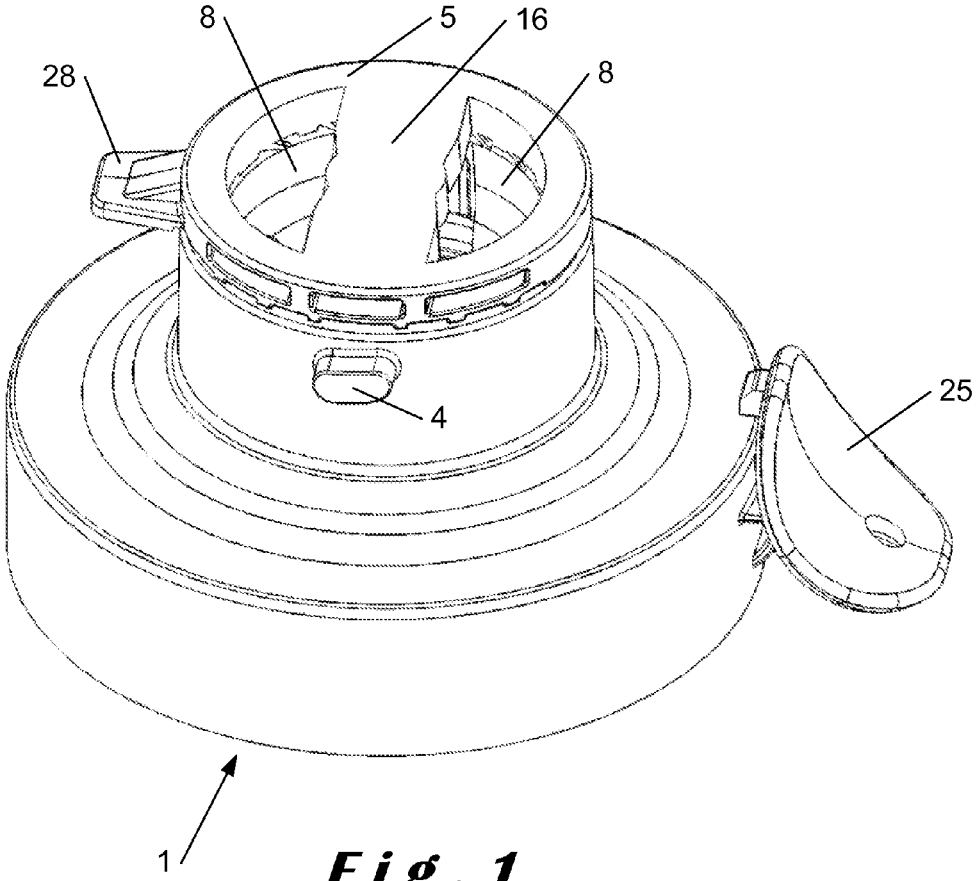
FIG. 1 shows a top perspective view of a first coupling piece according to the present invention, ready to be snapped onto the container and with the integrated cap in the original position as made by injection moulding.

The containers for compounds under pressure are typically designed as cylinders. The bottom is usually closed off by flanging a concave bottom plate onto the cylinder. The top of the cylinder is typically closed off by flanging on a convex head plate, with therein a central opening through which the container may be filled with its content. As explained before, after filling, this opening may then be closed off with a valve through which the container content may be released using the pressure which is built up inside the container. At room temperature, the pressure inside a filled container is typically about 5 bar gauge. The containers typically are able to remain intact up to a pressure of 18 bar gauge, and are designed to not burst open with a pressure below 21.6 bar gauge. The container valve is typically designed to resist a pressure up to at least 22 bar gauge. Other containers exist, which are only able to remain intact up to a pressure of 12 or 15 bar gauge. The container valve usually comprises a valve cup, i.e. a round metal cup which may be flanged at its perimeter into the central filling opening of the container, optionally in addition using a rubber seal. In the conventional valve design, the valve cup is supporting a central rubber grommet through which a usually plastic valve stem sticks. The stem is rigid and typically has a central duct which turns, just before the stem ends at its lower end in a blind flange, sideways into one or more, typically four, side openings. In a state at rest, the rubber grommet pulls the blind flange up against the bottom of the grommet and seals off the openings. The valve may be opened by tilting the stem or by pushing the stem down relative to the grommet or relative to the cup, and whereby at least one of the side openings in the valve stem becomes available for the container content.

Because the rubber of the grommet of the conventional valve, particularly when carbon black has been used as a filler in the rubber, allows diffusion of water, which then may react with certain compounds in the container to form a sticky solid, the conventional valve has the disadvantage that the valve stem may become blocked over time, or when the container has been for some time in a horizontal position. This may already occur when the container has been lying on its side for a period of only 3 to 6 weeks. A further disadvantage is that the rubber of the grommet also allows diffusion of propellant gasses out of the container, such that the container may lose most or all of its pressure after a while. For these reasons, other types of valves have been developed, which may not comprise the rubber grommet as described for the conventional valve. Such container valves may also be known as "feststof" valves, and suitable variants thereof are for instance described in WO 2009/004097, U.S. Pat. No. 5,014,887, WO 03/062092, or U.S. Pat. Nos. 5,215,225, 5,549,226 and 6,058,960. These valves have no rubber grommet, or only have a grommet on the outside part of the valve which is not in contact with the contents of the container, but do have a valve cup and a stem. The valve cup may still be susceptible to deformation under internal pressure inside the container. These valves are typically provided with a sealing section at the outside of the valve stem, suitable for forming a seal when brought in contact with a gun adaptor, a dispensing gun, or a handheld applicator.

These "feststof" valves may thus be characterised in that the materials of the valve parts coming in contact with the container contents are substantially impermeable for water and/or propellant gasses. The valves may for instance be provided with one or even more than one metal spring, being a spiral spring or a leaf spring or a combination thereof. The spring or springs may be provided and tailored such that the valve may be easier to open than a conventional valve, and thus offer further improved ergonomics to the user, as well as improved aiming and dosing capabilities. The springs may also assure a faster closing of the valve as compared to the conventional valve. A valve with an internal spiral spring is for instance disclosed in U.S. Pat. No. 5,014,887. Valves with external spiral springs may be found as part of the family of valves MIKAVent PU-RF, available from Mikropakk. Particularly suitable feststof valves are disclosed in EP 2028131 A2. The applicants prefer the valve which is shown on FIG. 6 of EP 2028131 A2, which has an external spiral spring, and is particularly simple in design and easy to assembly. Valves with a blade spring may be found in U.S. Pat. No. 6,058,960, WO 03/062092 and WO 2009/004097.

The first coupling piece according to the present invention is rotatably connectable to a second coupling piece as part of an assembly as disclosed in WO 98/43894. This second coupling piece is provided with a guide, typically two guides, preferably two grooves located on opposite sides of the second coupling piece. The first coupling piece is then preferably provided with a protrusion, typically two protrusions, and preferably two pins located on opposite sides of the first coupling piece, for cooperating with the guide or grooves provided in the second coupling piece, the protrusion being moveable within the guide between a first position and a second position, in not more than one full 360 degree turn, the first position corresponding to an uncoupled state of the coupling and, when the first coupling piece is attached to a container comprising a valve for closing off the container, a closed position of the valve, and the second position corresponding to a coupled state of the coupling and correspondingly an opened position of the valve. We prefer that the coupling may be made with not more than a half or 180 degree turn, and more preferably with not more than a quarter or 90 degree turn.

With such an assembly, the coupling may be effectuated in one continuous movement, whereby simultaneously the container valve is opened in one continuous movement. Because the action time which is exerted to the valve is short, the risk for a leaking of the valve during the effectuation of the coupling is very small. Such a continuous one turn movement consequently allows minimizing the leaking of the valve, during the effectuation of the coupling. The coupling may also be made swiftly in one continuous and short movement, which is time saving and very convenient for the user, in particular for an intensive user such as a professional.

Further according to the present invention, the first and second coupling pieces are preferably provided with means for bolting said coupling. This is advantageous as it provides a means for preventing a loosening of the coupling in case the container contains a pressurized compound. In the alternative of the screw connection discussed above, this is achieved by having the screw threads engage with each other over a plurality of windings, and which results in the disadvantages already mentioned.

The means for bolting the coupling are preferably reversible, so that the coupling may be re-used several times, i.e. opened and closed again and again, and several times. It also allows replacing an empty container with another one having the same first coupling piece attached to it.

Further according to the present invention, the means for bolting the coupling preferably comprises a snap lock. Such a snap lock is typically bolted automatically when the coupling is effectuated.

The protrusion and guiding according to the invention preferably comprise at least one pin-and-groove connection.

With such a pin-and-groove connection, the coupling may be effectuated in one short movement. Thereby a large tolerance can be provided, so as to facilitate the insertion of the pin in the groove, without thereby opening the valve and involving a risk to leaking of the valve. The valve is effectively only opened upon the movement of the pin in the groove, when the coupling piece which is provided for attachment to the dispensing gun, engages with and acts upon the container valve.

The pin-and-groove connection preferably comprises two diametrically opposed pins, and two diametrically opposed grooves, which grooves are provided to co-operate with the pins, so as to prevent that the coupling pieces, upon effectuation of the coupling, may be tilted with respect to each other.

The first coupling piece according to the present invention is provided for attachment to the container, preferably comprising means for attaching the coupling piece to the collar or flange where the container valve cup connects with the container head, usually by being "shrunk" onto the container head, more preferably to the flange connecting the container head with the cylinder, and yet more preferably comprising means for attaching the coupling piece to both these flanges.

In the alternative of the screw connection discussed above, the coupling piece for attachment to the container is typically attached to the flange of the valve cup with the container head. This has the disadvantage that it may be very difficult, sometimes impossible, to unscrew the coupling. It may further occur that, upon screwing or unscrewing the coupling, when some force is exerted on the coupling piece, the coupling piece may move with respect to the container, sliding around on the valve cup. This may for example occur when the screw thread is fastened rather thoroughly, or when some of the compound from the container has contaminated the screw thread and may act as an adhesive. It may result in a coupling which may not be uncoupled again, such that the second coupling piece or even the dispensing gun becomes useless and has to be discarded.

By attaching the coupling piece to the two flanges, as is possible with the coupling piece of a preferred embodiment of the present invention, the contact surface between the coupling piece and the container may be significantly increased. The increased contact surface results in an increased frictional resistance such that a higher momentum needs to be overcome in order to permit the coupling piece to move with respect to the container. This offers an improved attachment of the coupling piece to the container, and helps to prevent that the coupling piece is moveable with respect to the container. It also results in a lower rejection rate of used second coupling pieces.

In an embodiment of the present invention, the first coupling piece is made of a plastic material, and this may be provided with fibrous reinforcing material. The coupling piece is preferably made of polyamide (PA), for instance of nylon 6, or polypropylene (PP). Other suitable materials are high density polyethylene (HDPE), polycarbonate (PC) or acrylonitrile butadiene styrene rubber (ABS), or mixtures of any of the named materials. Preferably also the second coupling piece is made of a similar or identical construction material. This brings the advantage that the intrinsic resilience of the plastic material is helpful for the bolting and unbolting of the snap lock.

In an embodiment of the present invention, preferably the larger of the two projections in (iv) is extending at most 2 mm, more preferably at most 1 mm beyond the perimeter of the smaller projection. More preferably the two projections overlap as fully and exactly as possible, given a small tolerance of at most 0.6 mm, preferably at most 0.4 mm, more preferably at most 0.2 mm and even more preferably at most 0.1 mm. This brings the combined advantage that the shielding effect of the cap for the valve may be maximized, while at the same time the area of engagement of the internal rim of the first coupling piece, or the sections of such internal rim, with the valve cup may also be maximized, while the capability to produce the coupling piece as one single product in one production step is maintained.

In an embodiment of the present invention, the cap comprises an outer ring and a center piece running along one diameter. The outer ring of the cap provides room for a plurality of low strength connections between the cap and the coupling piece and which may be formed in the single production step. This cap design also allows to leave two open segments in the cap within the outer ring and on both sides of the center piece running across the circular cap along one diameter, through which parts of the mould, preferably one single part of the mould, i.e. the part or parts intended for forming the internal surfaces of one or preferably two internal support legs may move back out of its or their position during the moulding step, and hence may readily release the produced coupling piece after the moulding step. The internal legs may thus preferably provide two sections of an internal rim for engaging with the valve plate. The applicants have found that this embodiment is one possible way in which the sections of the internal rim may together provide at least 30%, preferably at least 35%, more preferably at least 40%, even more preferably at least 45% and most preferably 50% of the full circle internal rim such as the one which was provided in the conventional design as disclosed in WO 98/43894. The applicants have found that two sections together providing such portion of a full circle internal rim provide sufficient exterior support to the valve cup in order to secure the valve stem in its desired position.

In one embodiment of the present invention, the coupling piece is further provided with at least one first element and the integrated cap is provided with at least one second element for cooperation with the first element in order to removably reattach and/or reclose the cap onto the first coupling piece, i.e. to attach the cap onto the first coupling piece after it has been broken off from the coupling piece. This converts the cap into a reclosable cap. This feature brings the advantage that the valve compartment may be reclosed with the cap in between successive uses of the same container. In a preferred embodiment, the coupling piece is provided with at least two such first elements and the cap is provided with at least two such second elements, bringing the advantage of at least two fixing points for the cap onto the coupling piece, providing a stronger attachment of the cap and hence a lower risk for unintentionally loosing the cap. In a preferred embodiment, the cap is provided with two male elements, such as cylindrical click-in legs sticking out downwards, and the coupling piece is provided with two female elements, such as corresponding sleeves, and the legs and sleeves are provided to cooperate such that the legs may be removably inserted into the sleeves and engage sufficiently to keep the cap in place. We prefer to have the male elements to stick out downward from underneath the center piece of the cap, and the sleeves being provided as part of the internal legs of the first coupling piece which are providing the sections of the internal rim for engaging with the valve cup. This brings the advantage that these elements may be formed at the same time as the first coupling piece including its integrated cap, and that the entire coupling piece may be made in one single production step, such as an injection moulding step. After the cap has been broken off from the coupling piece, the elements may be provided such that they match and are able to cooperate when the cap is turned, such as around the axis of symmetry of the coupling piece, over an angle, such as about 90°, from its original position.

Preferably the cap has a lip or handle for facilitating the handling of the cap, such as the manual breaking off of the cap from its integrated position on the coupling piece and/or the removal of the cap from its reclosed position.

In the preferred embodiment wherein the coupling piece has been further provided with the first means suitable for coupling with the suitable handheld applicator, we prefer that the two means suitable for providing a coupling between the coupling piece and the handheld applicator comprise a guide and at least one protrusion for cooperating with the guide, preferably a pin-and-groove connection, which protrusion is moveable within the guide between a first position and a second position, in not more than one full 360 degree turn, the first position corresponding to an uncoupled state of the coupling between the coupling piece and the handheld applicator and a closed position of the container valve, and the second position corresponding to a coupled state of the coupling between the coupling piece and the handheld applicator and a position of the container valve which is closed and ready to be opened by the action on the handheld applicator. In this embodiment, the coupling piece is dual purpose and may also serve for handheld use as explained above. We prefer that the coupling with the handheld applicator may be made with not more than a half or 180 degree turn, and more preferably with not more than a quarter or 90 degree turn.

With such an extra feature, the coupling with the handheld applicator may be effectuated in one continuous and short movement which is time saving and very convenient for the user.

The protrusion and guiding for the coupling with the handheld applicator according to the present invention preferably comprise at least one pin-and-groove connection. With such a pin-and-groove connection, the coupling may be effectuated in one short movement. Thereby a large tolerance can be provided, so as to facilitate the insertion of the pin in the groove. We prefer the groove or grooves to have a wider opening where the pin has to enter, and to taper narrower towards their end or stop. This makes it easier to achieve a correct position of the pin or pins for entering their respective groove, but at the same time secures that the coupled position of the two pieces is accurately as desired.

The pin-and-groove connection preferably comprises two diametrically opposed pins, and two diametrically opposed grooves, which grooves are provided to co-operate with the pins. This reduces the risk that the handheld applicator, when being coupled to the first coupling piece, would unintentionally tilt or push the valve stem down with respect to the grommet and cause an unintentional opening of the valve.

In an embodiment, we prefer that the first means suitable for providing a coupling between the coupling piece and the handheld applicator comprise two protrusions internal to the coupling piece and located diametrically opposite to each other with respect to the position of the container valve in the assembly of the container, the first coupling piece and the handheld applicator, preferably the first means comprising two pins for cooperating with two grooves in the handheld applicator.

Handheld applicators which are suitable for being coupled to the first coupling piece of the present invention, including the particular embodiments thereof which the applicants prefer, are fully described in the copending patent application EP-A-10164924.2. The applicants refer to that document for further details, preferred features and the various associated advantages thereof.

In another embodiment of the present invention, the coupling piece is further provided with an external flat surface, preferably the external flat surface being provided on the integrated cap. This brings the advantage that the coupling piece may be picked up by means of a vacuum applied through a suction cup engaged on the external flat surface provided on the coupling piece, preferably on the integrated cap, and the coupling piece may be released again by breaking the vacuum after the coupling piece having been brought into a position on the container which position is suitable for the coupling piece being snapped onto the container. This external flat and smooth surface enables a very convenient method for bringing the coupling piece in contact with a container before snapping the piece on the container and producing the assembly of the two parts.

The coupling piece according to the present invention is preferably further provided with a plurality of stabilizing pins suitable for stabilizing the position of the coupling piece on the container and/or the container head before it may be snapped onto the container. This better secures the coupling piece in the correct position for snapping it onto the flange or flanges of the container and/or valve cup as explained above. We prefer to provide these stabilizing pins as weak downward extensions of the support legs, and which are sufficiently weak such that they collapse when the first coupling piece is pushed or snapped onto the container. This way, the pins provide extra contact surface and detainment force on the valve cup against internal pressure buildup.

In another embodiment, the coupling piece according to the present invention is preferably further provided with a plurality of stabilizing stubs, for engaging with the flange of the container head with the cylinder, in addition to the conventional protruding rims provided for gripping over at least one and preferably both of the flanges. Such stabilizing stubs end up creating extra contact surface with the container which reinforces the attachment to the container compared to only having the collars or protruding rims which are conventionally provided for securing the attachment. As such, the stabilizing stubs further stabilize the position of the coupling piece on the container after it has been snapped onto the container.

The process for producing the coupling piece according to the present invention preferably comprises a single injection moulding step. The mould may be formed by for instance using at least four matching mould pieces, preferably only four mould pieces. Two of these mould pieces are preferably cooperating with each other, by approaching each other along the direction of the axis of rotation of the coupling, and may together form the internals, including the internal support legs, of the coupling piece and the cap, whereby one mould piece may delimit the upper surface of the cap and, through the open segments in the cap, also delimit the internal surfaces of the support legs which face the axis of rotation. The second and cooperating mould piece may suitably delimit the lower surface of the parts of the cap which are located in between the open segments in the cap, as well as the lower surfaces of the rest of the coupling piece including any peripheral rim and any recess and snap rim which may be provided in the interior side of the peripheral rim. The third and the fourth mould piece may then cooperate together to delimit the side surfaces of the coupling piece, to form the protrusion or guide required for effecting the coupling, the lip that may be provided as part of the cap, the lip or "snap" which may be provided on the peripheral rim of the coupling piece for bolting the coupling, and the at least one low strength connection between the cap and the coupling piece.

In the process according to the present invention the mould may therefore comprise at least 4 parts which are able to move relative to each other, preferably perpendicularly and/or in parallel to each other, as appropriate, for closing and opening the mould. We prefer to use only 4 parts for the mould.

In a preferred embodiment, the process further comprises the step for assembling the first coupling piece with a container.

In this embodiment, we prefer that the first coupling piece is picked up by means of a vacuum applied through a suction cup engaged on the external flat surface which is preferably provided on the coupling piece, more preferably on the integrated cap, and may be released by breaking the vacuum after the coupling piece having been brought into a position on the container which position is suitable for the coupling piece being snapped onto the container.

In the assembly according to the present invention comprising a container and the first coupling piece, the container may comprise a composition suitable for forming a silicone paste, a polyurethane (PU) foam, or a glue.

The container according to the present invention may contain either a one or two component formulation, or a so-called 1.5 component system. In the case of the one-component formulations, the moisture reactive groups of the dispensed prepolymer cure by reaction with atmospheric moisture. This reaction is usually accompanied by cross-linking and an increase in volume. In case of 2-component systems, chemical curing is achieved via reaction of the reactive groups with the second reactive component (mostly amines, water or hydroxyfunctional molecules). With so-called 1.5 component foams a hydroxy or amine component or a mixture thereof is added to the prepolymer before being dispensed in such an amount that full or partly conversion of all moisture reactive groups is achieved. Further moisture curing (if needed) is achieved after dispensing. This 1.5 component system brings the advantage that the curing of the applied foam is significantly faster, such that the foam may be cut or trimmed quicker after the application thereof, which is of convenience for the user, particularly for the professional user. A further advantage of the 1.5 component foam system is that the foam reaches a higher final density, which provides better mechanical properties, such that this foam is particularly suitable for construction purposes, and e.g. may be used for mounting window frames and doors even without needing screws or bolts.

The applicants prefer to achieve a foam which ultimately has an open cell structure, because this brings an advantage in that the foam is less susceptible for shrinkage This reduces the risk that the foam would break loose from its surface, or that crevices develop, through which the insulation properties of the foam may be impaired. Also the risk for loosing the mechanical properties is thereby reduced. An open cell foam provides better integrity, in particular over the longer term. In addition, when flammable propellants are used, an open cell structure foam will also ultimately achieve better fire proof and flame retardant properties because the propellants are able to migrate out of the foam. For this purpose, the applicants prefer to add a cell opener to the foam formulation. Cell openers are well known in the art, and typically suitable compounds include paraffin or silicon oils, silicone-free polymers based on polyvinyl alkyl ether with a foam-inhibiting effect for example BYK-051, -052 and -053 from BYK-Chemie GmbH, silicon-containing polymers like Tegostab B-8871, Tegostab B-8934, Tegostab 8935, available from Evonik, Niax L-6164, available from GE Silicones, Struksilon 8101, Struksilon 8002, available from Schill & Seilacher. Mechanical cell opening can be achieved by incorporating solids, for example talcums, calcium carbonates, etc. Defoaming additives applied in low concentration levels are also possible cell-openers. The cell opening additives are typically added in quantities of 0.01 to 2, preferably 0.1 to 1 wt % (as such or as combinations thereof), usually based on the prepolymer component. Known foam stabilizers having cell opening activity are: Tegostab B8871, 8934 and 8935 available from Evonik; Struksilon 8101 and 8002 available from Schill and Seilacher. Known cell openers and anti-foaming agents (depending on their concentration) are: Baysilon M100 available from Bayer, Paraffinoil 7160 available from Merck, Niax L6164 available from Momentive, and the Ortegol 501 (polybutadiene) en 505 available from Evonik. Other types of silicone oils and paraffinic oils may be considered as evenly effective.

The assembly according to the present invention may further comprise a handheld applicator, such as those disclosed in copending patent application EP-A-10164924.2. Alternatively the assembly may further comprise the second coupling piece or gun adaptor of the Click-and-Fix coupling system, for coupling of the container with a dispensing gun, and may then further comprise a dispensing gun suitable for applying the component or compound present in the container. This second coupling piece or gun adaptor is preferably the same as disclosed in WO 98/43894.

A preferred embodiment of the first coupling piece according to the present invention is shown in the accompanying drawings, in which like elements are indicated by the same numerical reference.

In FIG. 1, a first coupling piece 1 is shown as produced in one single step by means of injection moulding. In FIG. 1, one of the two pins 4 is visible which is intended for being accepted in a groove provided in the second coupling piece (not shown). Another similar pin 4 is present at the back side of the coupling piece 1, and opposite the pin 4 shown in FIG. 1. The coupling piece 1 in FIG. 1 is shown with its integrated cap 5 in the position as the coupling piece leaves the mould from the injection moulding machine. The cap 5 is provided as comprising an outer ring and a center piece running along one diameter, creating two open segments 8. The cap 5 is further provided with a flat external surface 16 and with a handling lip 28, also called the cap lip. Further is visible in FIG. 1 the lip or snap 25 which is provided for handling the snaplock for bolting the coupling with the second coupling piece, such as in the manner as described in WO 98/43894.

Figure 2:
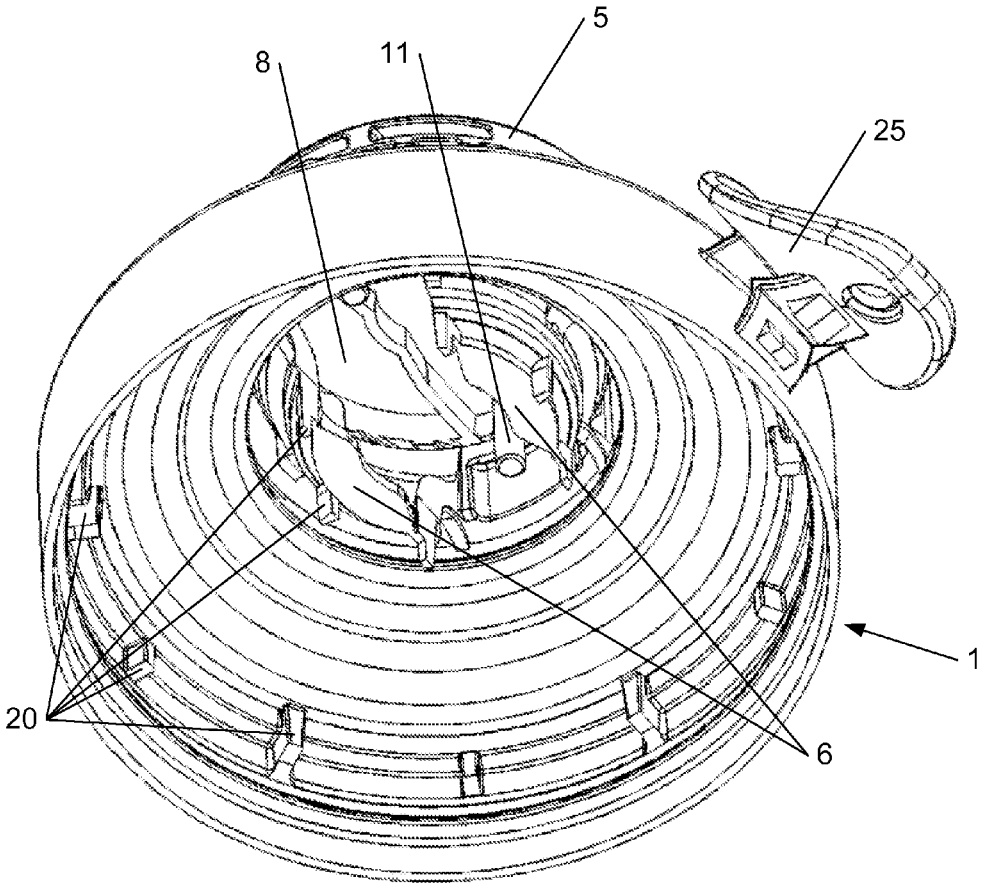
FIG. 2 shows a bottom perspective view of the coupling piece of FIG. 1.

In FIG. 2, the same coupling piece 1 is shown from a bottom perspective. The lip or snap 25 of the snaplock is clearly visible. Of cap 5 only a small outer part is visible. In this bottom view, one of the open segments 8 in the cap is visible, as well as one of two cylindrical click-in legs 11 sticking out downwards from underneath the center piece of the cap. FIG. 2 also shows the two internal support legs 6 for engaging with the valve cup of the container. Further shown on FIG. 2 are various weak stabilizing pins and stabilizing stubs 20 (not all being referenced) for stabilizing the position of the coupling piece 1 on top of a container before it may be snapped onto it and for reinforcing the attachment of the coupling piece with the container against a torque force.

Figure 3:
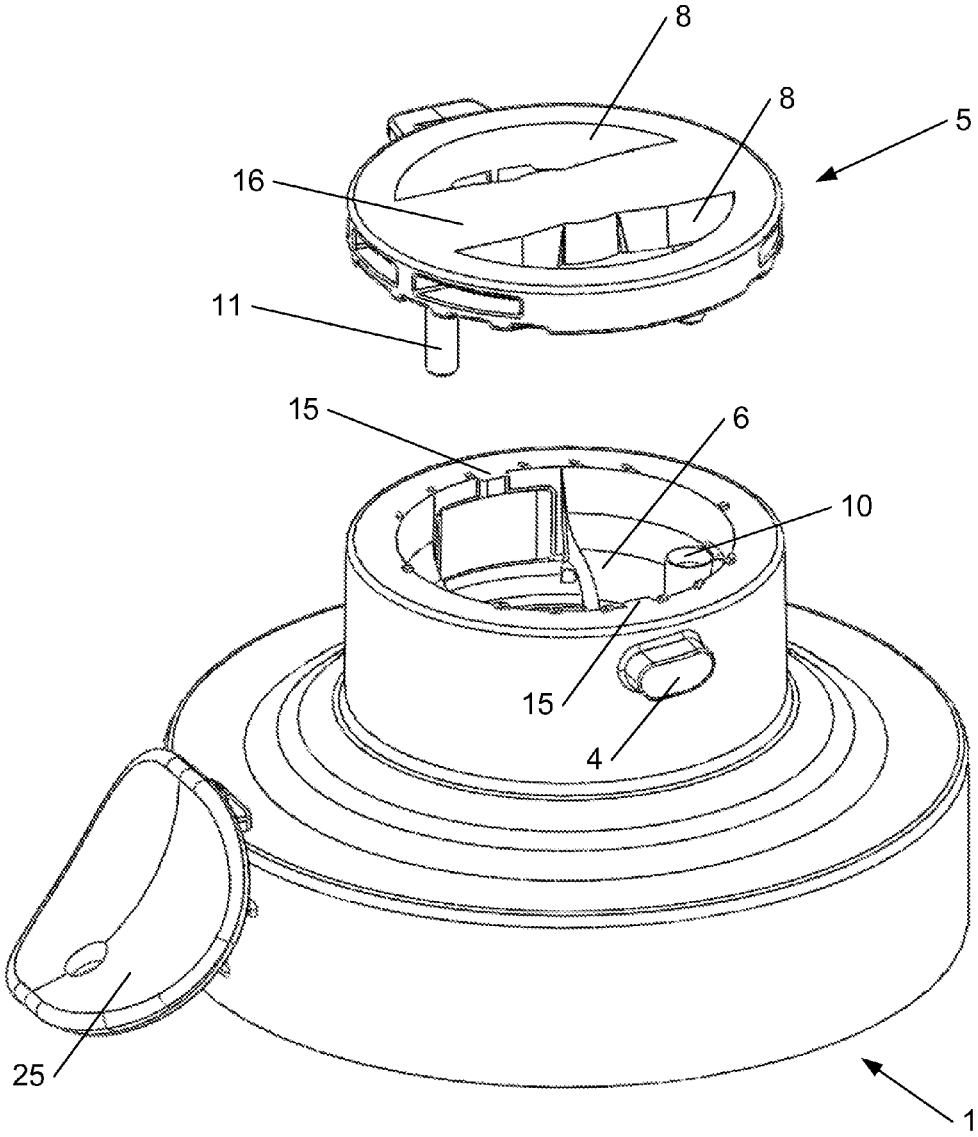
FIG. 3 shows a top perspective view of the same coupling piece, now with the cap torn off, in exploded view, and turned 90° around a vertical axis, ready to be replaced onto the coupling piece.

In the top perspective view provided with FIG. 3, the cap 5 is broken off from the rest of the coupling piece 1 and is shown in an exploded position. Visible are the two open segments 8 in the cap, the flat upper surface 16 and one of the click-in legs 11 of the cap. On the main part of the coupling piece 1, again one of the pins 4 and the lip 25 are visible. Further are seen two pins 15, internally to the coupling piece, for enabling the coupling with a suitable handheld applicator (not shown) in the manner fully described in copending patent application EP-A-10164924.2. Also showing is the top part of an internal support leg 6 and of one of two sleeves 10 for inserting the click-in legs 11 of the cap.

Figure 4:
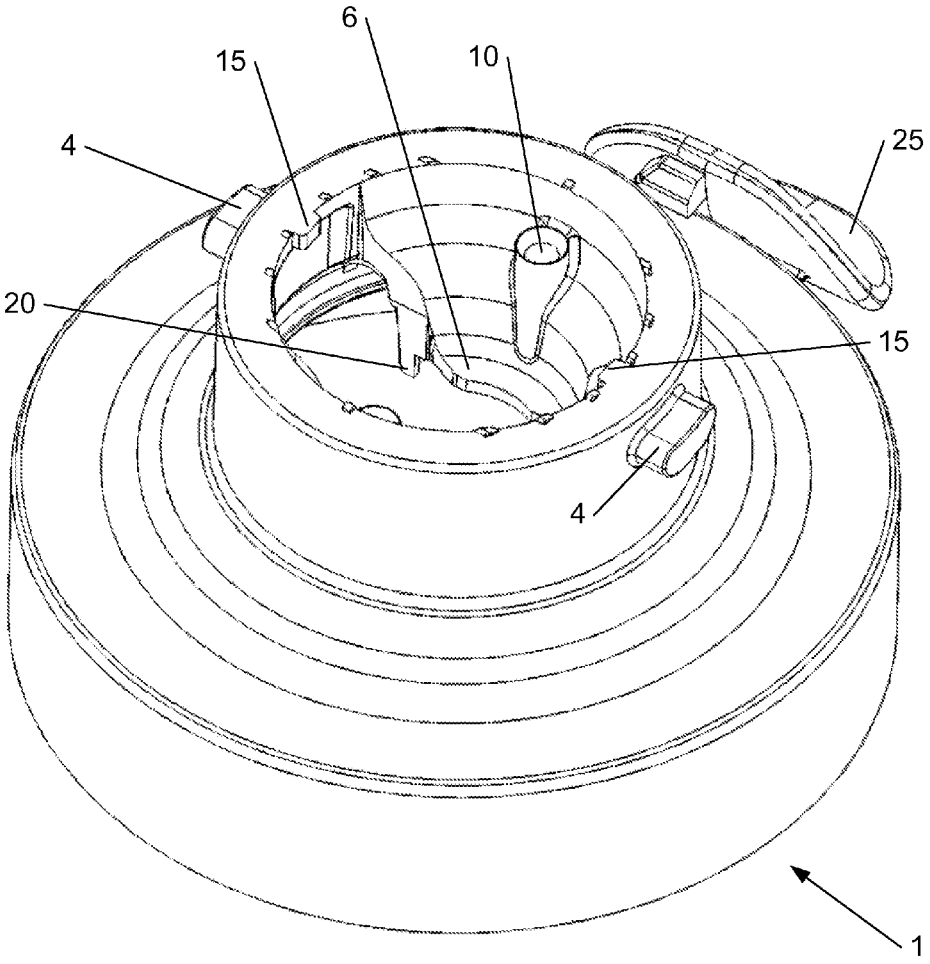
FIG. 4 shows a top perspective view of the same coupling piece of FIG. 3, without the cap and from a position which offers a better view of the internals of the coupling piece.

FIG. 4 provides a higher perspective view, of the coupling piece 1 without the cap 5. Shown are the lip or snap 25, now two pins 4 for the Click-and-Fix coupling with a second coupling piece, an almost full view of one internal support leg 6 and a sleeve 10, and also the two internal pins 15 opposite each other for coupling with the handheld applicator as explained above.

Figure 5:
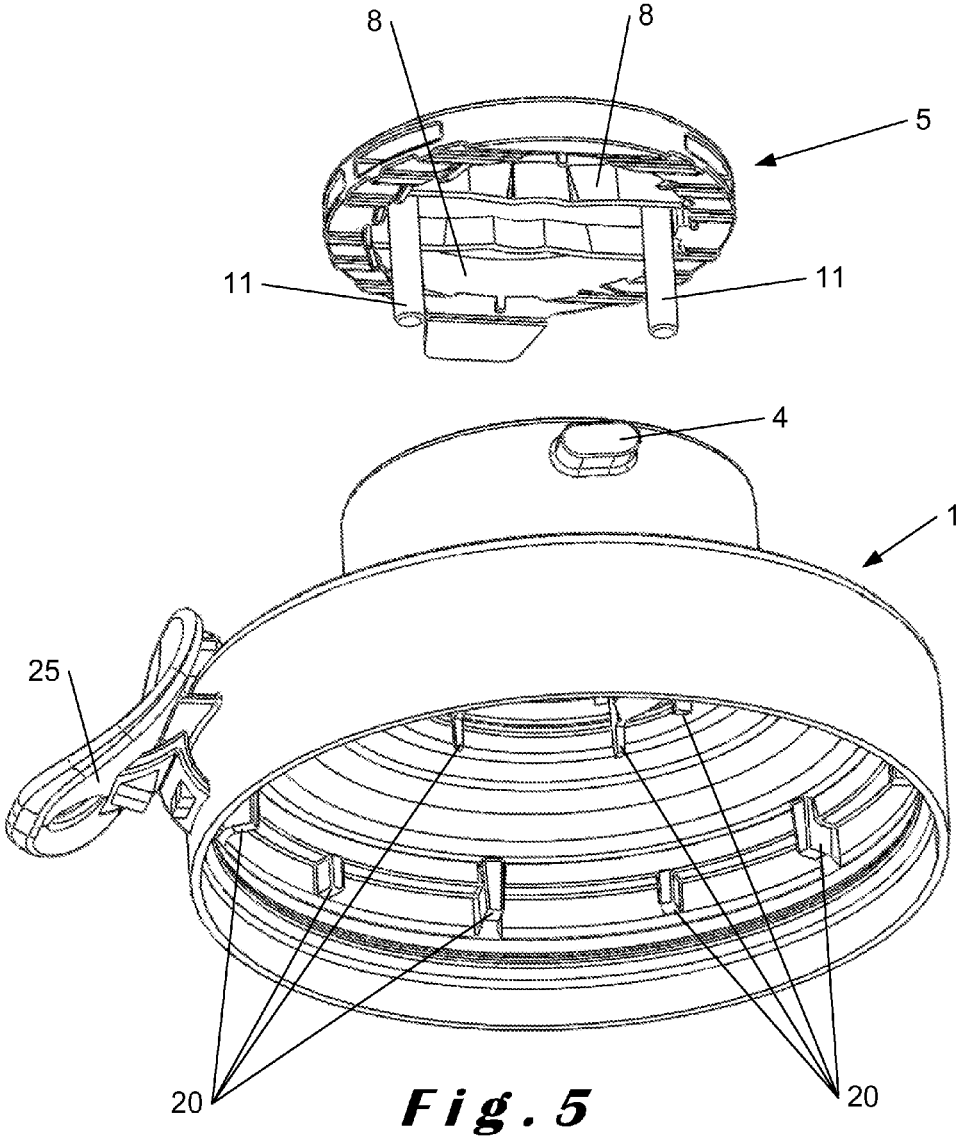
FIG. 5 shows a bottom perspective view of the situation from FIG. 3.

In FIG. 5, the cap 5 is shown in torn off and exploded position, turned 90 degrees such that the legs 11 are above the sleeves 10 (not showing as they are hidden inside the coupling piece) and the cap may be lowered to reclose the cap onto the coupling piece. Also shown are lip 25, one pin 4 and several weak pins and stabilizing stubs 20 as part of the coupling piece, and the open segments 8 as part of the cap.

Figure 6:
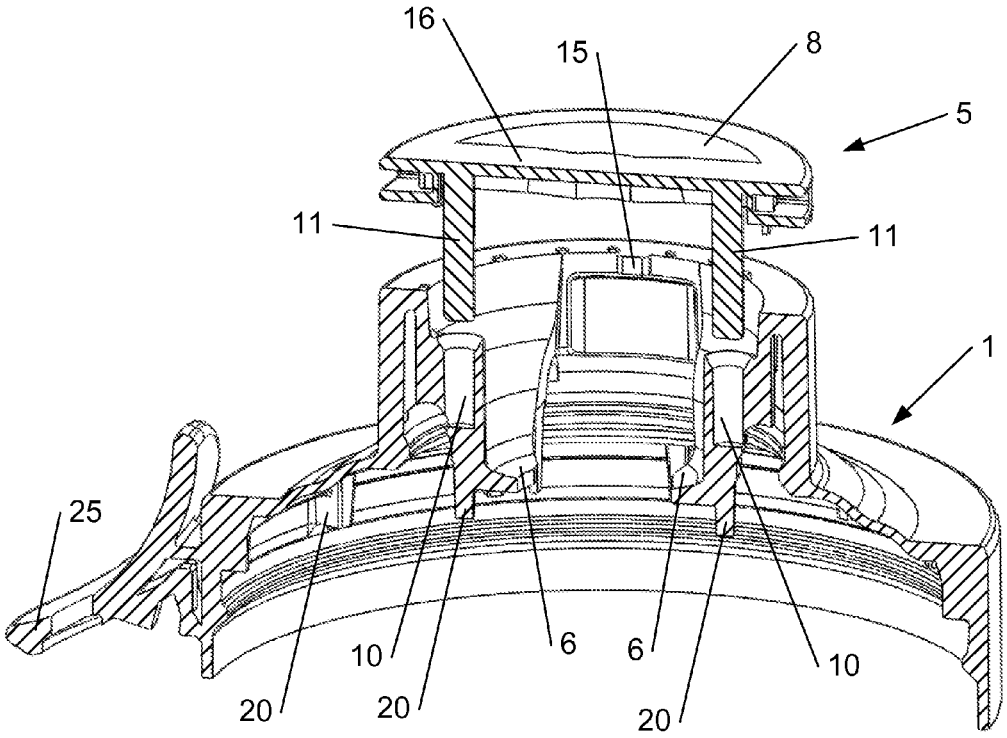
FIG. 6 shows a perspective view of half of the same coupling piece as in FIGS. 1 to 5, with the cap broken off and ready to be reattached onto the coupling piece, the assembly being cut in the middle through the central symmetry axis of the coupling piece and through the middle of the outer lip (the so-called "snap") for locking the coupling with the second coupling piece.

In the perspective cross-section of the coupling piece 1 with the cap 5 ready to be replaced in FIG. 6 are shown one open segment 8 and part of the flat and smooth external surface 16 on the cap, two legs 11 of the cap ready to be inserted into two cooperating sleeves 10 provided in the coupling piece itself, which are provided as part of the internal support legs 6. Further shown are one pin 15 internal to the coupling piece, a number of weak pins 20 as part of the support legs 6 and stabilizing stubs 20 as part of the coupling piece body, and the lip or snap 25 of the snaplock.

Figure 7:
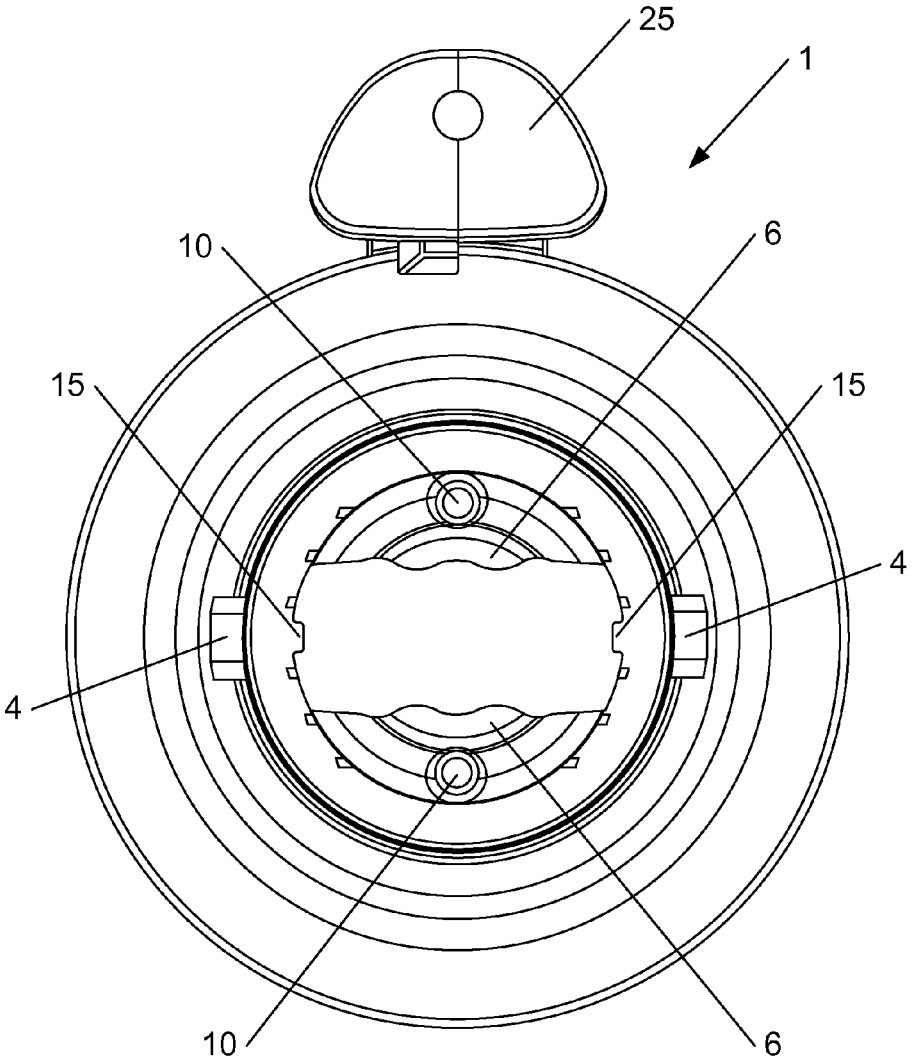
FIG. 7 shows a fully top view of the first coupling piece with the integrated cap broken off and removed.

In the top view of coupling piece 1 with the integrated cap broken off shown by FIG. 7, the lip 25, the two pins 4, and the two internal pins 15 are also shown. The top view further provides full top view of the internal support legs 6 in which sleeves 10 are integrated. The plane of the drawing in FIG. 7 is a plane perpendicular to the axis of rotation of the coupling of the first coupling piece with the second coupling piece, which axis crosses the plane of FIG. 7 in the center point of coupling piece 1. From internal support legs 6 are thus clearly showing the projections of the internal surfaces thereof which face the axis of rotation and made along this axis of rotation. This projection is according to the present invention fully comprised with a very small tolerance in a projection of the open segments 8 in the cap 5 (not shown) made along the same axis and onto the same plane of the drawing in FIG. 7.

Figure 8:
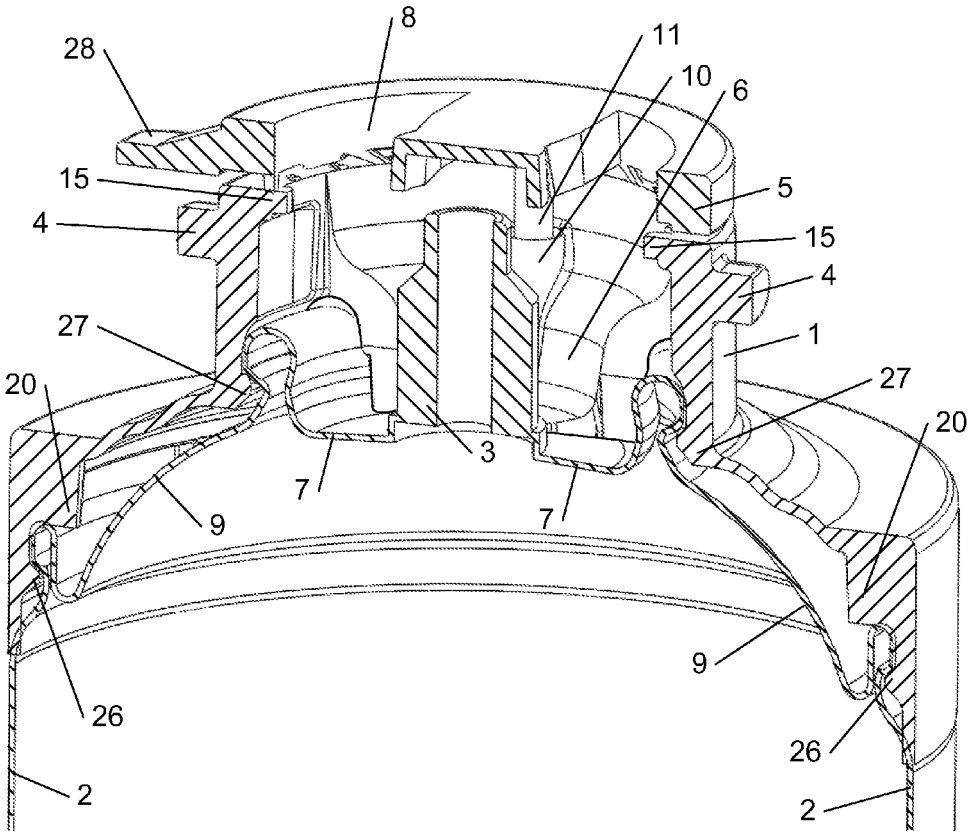
FIG. 8 shows a cross-section through the central symmetry axis of the coupling piece and perpendicular to the cutting plane in FIG. 6, of the first coupling piece of FIG. 6 snapped onto a container which is closed off with a valve (of which the stem is not shown in full detail, nor any grommet) and with the cap replaced onto the coupling piece.

FIG. 8 shows part of a cross-section of an assembly of the coupling piece 1 with a container 2 including its valve 3 having a valve cup 7. The cap 5 has been broken off from its original position integrated with the coupling piece, and was replaced onto the coupling piece to again close off the valve compartment. The cap is therefore shown as an independent object in the drawing, with the cross-section hatched differently than this of the coupling piece body. The cross-section cuts through the open segments 8 in the cap, and the top part of one clicking-in leg 11 is also noticeable, clicked into a cooperating sleeve 10. The cross-section shown in FIG. 8 also cuts through the two opposite internal pins 15 which are provided for the coupling with the handheld applicator and also through the two external pins 4 which are provided for the coupling with the second coupling piece or gun adaptor. The cross-section shown in FIG. 8 further cuts through two of the stabilizing stubs 20 which are engaged with the flange connecting the container head 9 to the container cylinder 2, and the attachment of the coupling piece 1 with this flange is further conventionally secured with protruding rim 26 which is snapped into the collar of the flange. Similarly the cross-section cuts through protruding rim 27 which is snapped into the collar of the flange connecting the valve cup 7 to the container head 9, as with any "shrunk valve", i.e. either a conventional or a so-called "feststof" valve. Also visible is one internal support leg 6 behind the valve 3, and which is engaged with the valve cup 7.

Having now fully described this invention, it will be appreciated by those skilled in the art that the invention can be performed within a wide range of parameters within what is claimed, without departing from the spirit and scope of the invention. As understood by those of skill in the art, the overall invention, as defined by the claims, encompasses other preferred embodiments not specifically enumerated herein.

The invention claimed is:

1. A first coupling piece for attachment to a container which coupling piece is rotatably connectable to a second coupling piece provided for attachment to a dispensing gun for applying a component present in the container, the two coupling pieces together providing a coupling between the container and the dispensing gun, the container comprising a valve for closing off the container, whereby the container valve comprises a valve cup and is provided for being opened during effectuation of the coupling, one of the two coupling pieces being provided with a guide and the other coupling piece being provided with a protrusion for cooperating with the guide, which protrusion is moveable within the guide between a first position and a second position, in not more than one full 360 degree turn, the first position corresponding to an uncoupled state of the coupling and a closed position of the container valve, and the second position corresponding to a coupled state of the coupling and an opened position of the container valve, wherein (i) the first coupling piece comprises an integrated cap provided for being broken off manually and for requiring its removal in order to allow an effectuation of the coupling, (ii) the first coupling piece comprises at least one internal support leg which is providing an internal rim or sections of an internal rim for engaging with the container valve cup when the first coupling piece is attached to the container, (iii) whereby the integrated cap is provided with open segments, and (iv) whereby the area covered by a first projection, of the open segments in the cap and made along the axis of rotation of the coupling and onto a plane perpendicular to this axis of rotation, comprises the area covered by a second projection, made along the same axis and onto the same plane, of the internal surfaces of the internal support legs which face the axis of rotation.

2. The coupling piece according to claim 1 which is further provided with at least one first element and wherein the integrated cap is provided with at least one second element whereby the second element is provided for cooperation with the first element in order to removably reattach the cap onto the first coupling piece after it has been broken off from the coupling piece.

3. The coupling piece according to claim 1 which is further provided with at least one first coupler suitable for coupling with a handheld applicator for applying the component present in the container, which handheld applicator is provided with at least one second complementary cooperating coupler for providing the coupling between the first coupling piece and the handheld applicator, and being suitable, in an assembly of the container and the first coupling niece together with the handheld applicator, for enabling the opening of the valve by an action on die handheld applicator.

4. The coupling piece according to claim 3 whereby the at least two couplers suitable for providing a coupling between the coupling piece and the handheld applicator comprise a guide and at least one protrusion for cooperating with the guide, which protrusion is moveable within the guide between a first position and a second position, in not more than one full 360 degree turn, the first position corresponding to an uncoupled state of the coupling between the coupling piece and the handheld applicator and a closed position of the container valve, and the second position corresponding to a coupled state of the coupling between the coupling piece and the handheld applicator and a position of the container valve which is dosed and ready to be opened by the action on the handheld applicator.

5. The coupling piece according to claim 4 wherein the at least two couplers comprise a pin-and-groove connection.

6. The coupling piece according to claim 3 whereby the at least one first coupler suitable for providing a coupling between the coupling piece and the handheld applicator comprise two protrusions internal to the coupling piece and located diametrically opposite to each other with respect to the position of the container valve in the assembly of the container, the first coupling piece and the handheld applicator.

7. The coupling piece according to claim 6 wherein the at least one first coupler comprises two pins for cooperating with two grooves in the handheld applicator.

8. The coupling piece according to claim 1 further provided with an external flat surface.

9. The coupling piece according to claim 8 wherein the external flat surface 16 is provided on the integrated cap.

10. The coupling piece according to claim 1 which is farther provided with a plurality of stabilising pins.

11. The coupling piece according to claim 10 wherein the stabilising pins are suitable for stabilising the position of the coupling piece on the container before being snapped onto the container.

12. The coupling piece according to claim 10 wherein the stabilising pins are suitable for stabilising the position of the coupling niece on the container after being snapped onto the container.

13. The coupling piece according to claim 10 wherein the stabilising pins are provided as weak pins for engaging with the flange where the valve cup connects with the container head.

14. The coupling piece according to claim 10 wherein the stabilising pins are provided as weak pins for engaging with the flange of the container head with the cylinder.

15. The coupling piece according to claim 10 wherein the stabilising pins are suitable for gripping over at least one flange.

16. An assembly of a container and the first coupling piece according to claim 1.

17. The assembly according to claim 16 wherein the container contains a composition suitable for forming a component selected from a silicone paste, a polyurethane (PU) foam, a glue, and mixtures thereof.

18. The assembly according to claim 16 further comprising a handheld applicator.

19. The assembly according to claim 16 further comprising the second coupling piece and the dispensing gun suitable for applying the component present in the container.

20. A process for the production of the coupling piece according to claim 1, comprising the step of injection moulding.

21. The process according to claim 20 further comprising the step for assembling the coupling piece with a container.

22. A method of using the coupling piece of claim 1, comprising the step of attaching the coupling piece to a container.

* * * * *